United States Patent [19]

Snow

[11] 4,061,407

[45] Dec. 6, 1977

[54] ELECTRICAL CONNECTOR ASSEMBLY

[75] Inventor: John P. Snow, Sagamore Hills, Ohio

[73] Assignee: Samuel Moore and Company, Aurora, Ohio

[21] Appl. No.: 668,263

[22] Filed: Mar. 18, 1976

[51] Int. Cl.[2] ..... H01R 13/54

[52] U.S. Cl. ..... 339/75 P; 339/10; 339/44 M

[58] Field of Search ..... 339/10, 44 R, 44 M, 339/75 R, 91 R

[56] References Cited

U.S. PATENT DOCUMENTS

| | | | |
|---|---|---|---|
| 2,158,385 | 5/1939 | Schwien | 339/44 R X |
| 3,887,256 | 6/1975 | Klimek et al. | 339/44 M |

*Primary Examiner*—Roy Lake

*Assistant Examiner*—E. F. Desmond

*Attorney, Agent, or Firm*—Stevens, Davis, Miller & Mosher

[57] ABSTRACT

An electrical connector assembly has a receptacle and a plug having mating electrical contact members. The plug has a key or other protuberant member which is external of the receptacle. A cover on the receptacle is biased towards its closed position and has a latch member which engages the protuberant member to hold the plug against longitudinal movement relative to the receptacle. A spring clip member is attached to the plug and has a resilient portion which biases the cover towards the plug and thus increases the pressure of the cover against the plug and strengthens the lock formed by the latch member of the cover.

7 Claims, 4 Drawing Figures

ELECTRICAL CONNECTOR ASSEMBLY

This invention relates generally to an electrical plug and receptacle assembly and more particularly to such an assembly provided with a means for securing the plug in the assembly against relative movement.

A plug member and receptacle assembly is used for detachably connecting the electrical system of a trailer of a tractor-trailer vehicle to that of the tractor. The receptacle member is usually mounted in the front panel of the trailer and the plug member is electrically connected to the end of an electrical cable carrying an electrical current from the tractor to the trailer. The receptacle member usually has a cylindrical metallic body which encloses a plurality of electrically conductive prongs and the plug member has a corresponding number of electrically conductive bores adapted to receive the prongs when the plug is inserted in the receptacle. An annular flange is provided about the cylindrical body of the receptacle for bolting it to the panel of the trailer. The plug member is a relatively large and heavy member so support, external of the receptacle, is often required to prevent it from being shaken loose from the receptacle because of vibrations while the vehicle is operated.

Additionally, interest in providing coiled, retractile-type electrical cables as an improved electrical connecting means between trailer and tractor has recently increased. Such coiled, retractile-type electrical cables, by design, result in an increased axial force tending to separate the plug member from the electrical receptacle member than heretofore caused by weight alone associated with non-contractile type electrical cable configurations thereby further increase the need of providing a means of securing the plug member-electrical receptacle assembly against relative movement.

Metallic plug and receptacle assemblies of the type contemplated by the invention are known and are being used by the trucking industry. Examples of such assemblies are disclosed for example in U.S. Pat. Nos. 3,284,753 and 3,915,476. The receptacle is provided with a spring-loaded hinged cover having a latch member on its inner surface which cooperates with a raised longitudinally extending rib which acts as a key for mating the electrically conductive sleeves of the plug member with the prongs of the receptacle. The cover member is normally biased into a closed position and is pivoted from over the open end to insert the plug member into the cavity of the receptacle. When the plug member has been inserted into the receptacle to the point where its end lies against the closed end of the cavity, the cover member is released. The positioning of the latch member is such that its end facing the receptacle contacts the exposed end of the key to retard relative longitudinal movement between the plug and receptacle. Such a latching mechanism is effective when the vehicle is in motion but it has been found that it cannot be relied upon to maintain the plug member and receptacle in electrical contact while the vehicle is in motion and the assembly is subjected to the vibrations associated with movement of the vehicle over the roadway. Consequently, it has been proposed to provide a bracket member hinged to the flange of the receptacle which supports the plug member from underneath. Such a bracket member is not entirely satisfactory because it does not prevent longitudinal pull-out and it is difficult to release when dirt, snow or ice have accumulated around the hinge and because it must be bolted to the flange of the receptacle and is thus somewhat difficult to replace by the operator of the vehicle when it is away from a repair shop.

It has also been found that the biasing means associated with the electrical receptacle cover member may weaken or break or the latch member on its exposed surface may become rounded, thereby diminishing the ability of the cover member of insuring electrical contact relationship between the plug member and the electrical receptacle assembly member. It has been heretofore the costly practice to replace electrical receptacle assemblies having cover members suffering from such weakened or broken biasing means or rounded latching means.

It is therefore an object of this invention to provide an improved electrical plug member and electrical receptacle assembly. Another object of the invention is to provide an improved means of maintaining electrical contact relationship between an electrical plug member and an electrical receptacle assembly. A further object is to provide a means of improving resistance to axial forces that may tend to separate an electrical plug member from an electrical receptacle assembly. Yet another object is to provide a means of improving the useful life of an electrical receptacle assembly having a cover plate for use in maintaining electrical contact relationship between an electrical plug member and the electrical receptacle assembly. A more specific object of the invention is to provide an improved electrical connector assembly for a tractor-trailer vehicle.

Other objects will become apparent from the following description with reference to the accompanying drawing wherein FIG. 1 is a fragmentary diagrammatic illustration of the electrical connector assembly of a tractor-trailer vehicle;

The foregoing objects and others are accomplished in accordance with this invention, generally speaking, by providing an assembly of an electrical plug member and receptacle wherein the receptacle has a cover provided with a latch for cooperation with a protuberant member on the plug to maintain the plug in the receptacle with a member which biases the cover against the plug and prevents the cover from pivoting away from the plug while the assembly is subjected to vibrations. More specifically, the invention provides an electrical connector assembly having a receptacle provided with a hollow cylindrical body which encloses electrical contact points, an electrical cable having a plug which is adapted to be inserted in the cylindrical body and having electrical contacts which mate with those of the receptacle to establish an electrical circuit and an external protuberant member disposed on its surface at a point outside the receptacle when the plug is correctly inserted in the receptacle, a cover for the open end of the receptacle biased towards it closed position and having a latching member on its inner side disposed to engage the protuberant member on the plug and secure the plug in the receptacle and a clip secured to the plug member which is provided with a resilient portion which engages the cover and biases the cover towards the plug to secure the cover against pivoting movement relative to the protuberant member on the plug. In a preferred embodiment of the invention, the plug member and receptacle assembly having the resilient clip provided by the invention is the electrical connector between the tractor and trailer of a tractor-trailer vehicle.

Figure 1:
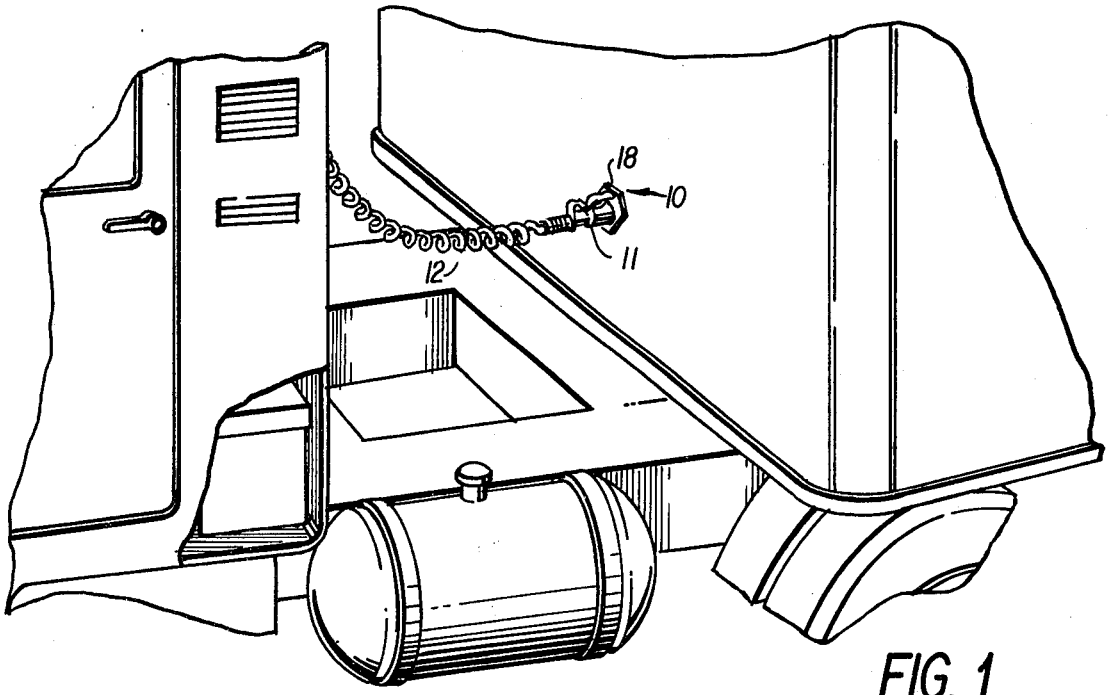

Referring now to FIG. 1 of the drawing. An electrical receptacle 10 is shown attached to the front panel of the trailer of a tractor-trailer vehicle. An electrical plug 11 is inserted in receptacle 10 and is electrically connected to the electrical wires of cable 12. Each of the electrical wires (not shown) of cable 12 is connected to one of the metallic sleeve-type electrical conductors 13 illustrated in FIG. 4. Receptacle 10 has prongs 14 which are inserted in sleeve members 13 when plug 11 is seated in the cavity of receptacle 10. A longitudinally extending groove 15 in the inner wall of the cylindrical body of receptacle 10 is adapted to receive a key 16 on the external surface of plug 11.

Figure 2:
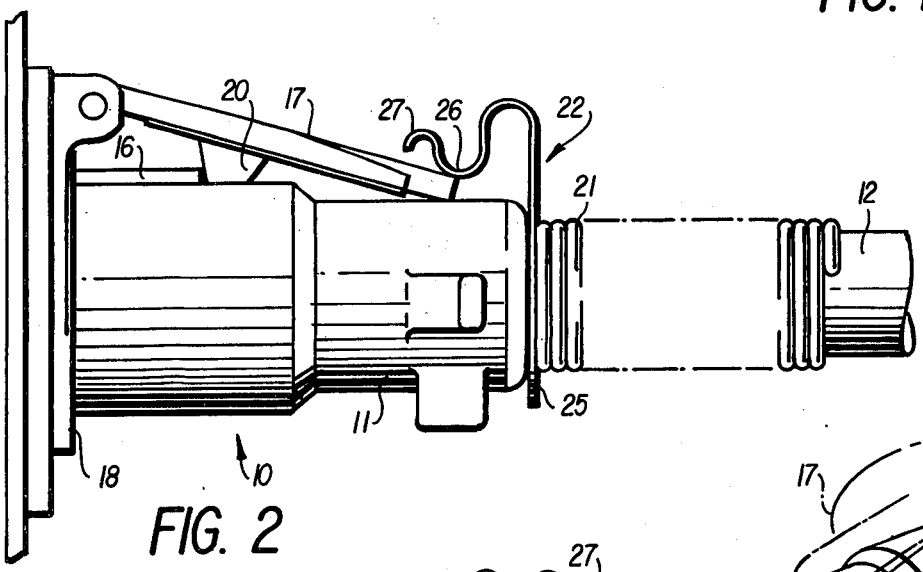
FIG. 2 is a side elevation of one embodiment of the electrical plug member and receptacle assembly provided by the invention.
Figure 4:
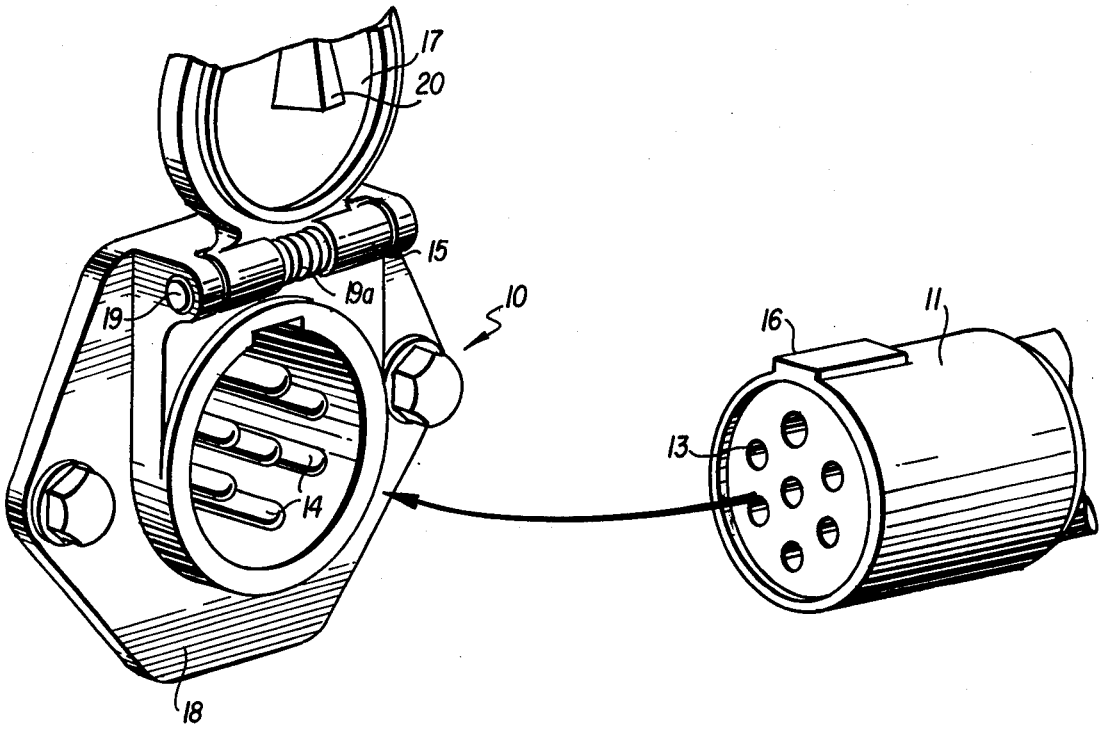
FIG. 4 is an exploded fragmentary view of one embodiment of an electrical plug member and an electrical receptacle assembly.

As shown in FIGS. 2 and 4, cover 17 is hinged on annular flange 18 of receptacle 10. A coil spring 19A (shown in FIG. 4) disposed about pin 19 in a notch in the hinge part of cover 17 biases cover 17 towards its closed position over the open end of the cylindrical body of receptacle 10. A latching member 20 on the inner face of cover 17 is disposed on cover 17 where it will engage the end of key 16 when cover 17 is biased towards plug 11.

Figure 3:
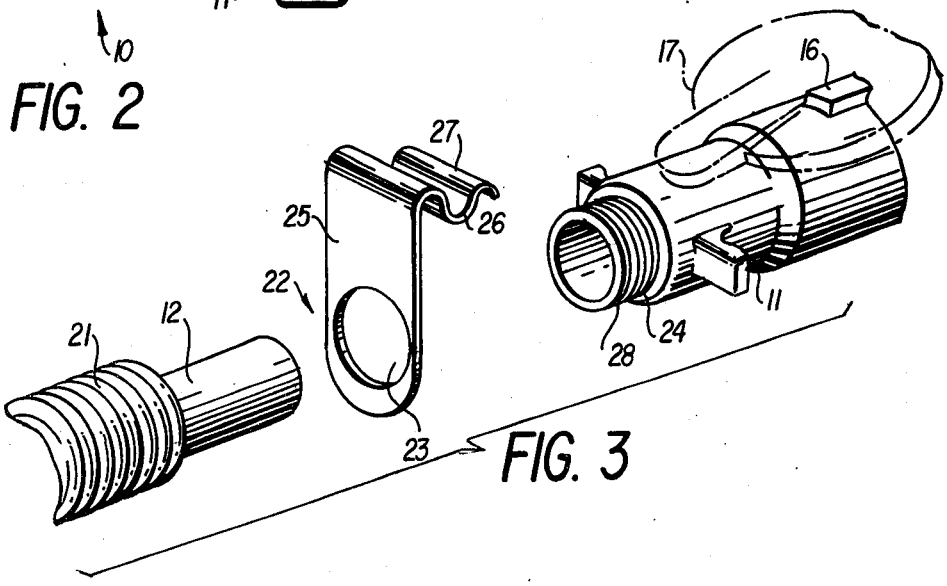
FIG. 3 is an exploded view of the embodiment of FIG. 2.

As shown in FIGS. 2 and 3, cable 12 may be provided with a coiled wire guard 21 having convolutions disposed in threads 28 external of shoulder 24. Guard 21 prevents the cable from kinking and may also be used as a means of securing plate member 22 to plug member 11 at shoulder 24. Plate member 22 is bent into the shape illustrated in the drawing to form a resilient portion which engages cover 17 and biases it towards plug 11. In the illustrated embodiment, plate member 22 is a spring clip having a body portion 25 bent at one end into a resilient U-shaped portion 26 which engages the upper surface of cover 17 and presses latch member 20 of cover 17 firmly against plug 11. Plate member 22 has an opening 23 which is disposed about a shoulder 24 on plug 11. The length of plate member 22 between the arcuate portion of opening 23 which is disposed against the lower surface of shoulder 24 and the surface of U-shaped portion 26 which engages cover 17 is slightly less than the distance between the top of cover 17 and the bottom of shoulder 24 when the assembly is disposed as illustrated in FIG. 2 of the drawing. In this way the U-shaped portion is under tension. When it is desired to remove clip member 22 from cover 17 so cover 17 can be lifted to a position where plug 11 can be withdrawn from receptacle 10, a finger is inserted in lip 27 and the U-shaped portion 26 is moved away from cover 17.

Plate member 22 may be made from any resilient material adapted to be shaped to form a spring clip such as a plastic or elastomer having properties similar to those of a spring steel but it is preferred to make the spring clip from spring steel or spring stainless steel which may be further provided, if desired, with a polymeric protective coating for improved weatherability and corrosion resistance. Plate member 22 may be attached to the plug member by any suitable means such as with screws or other fastening device.

The spring clip member provided by the invention has been described with reference to an electrical plug and receptacle assembly for connecting the electrical system of a tractor to the electrical system of a trailer of a tractor-trailer vehicle but it can be used in any electrical plug and receptacle assembly having a cover which is adapted to secure the plug against movement in the receptacle.

Although the invention is described in detail for the purpose of illustration, it is to be understood that such detail is solely for that purpose and that variations can be made therein by those skilled in the art without departing from the spirit and scope of the invention except as it may be limited by the claims.

What is claimed is:

1. An electrical connector assembly comprising a receptacle having an open end, a plug and cable assembly, said plug being inserted in the receptacle and making electrical contact therewith, an exposed protuberant member on the plug, a cover hinged to the receptacle and biased towards said open end, a latch depending from the cover and disposed against the exposed end of said protuberant member, and a one-piece spring clip member having a body portion secured to the said assembly and having an integral U-shaped resilient portion biasing the cover against the plug.

2. The electrical connector assembly of claim 1 wherein the said protuberant member is a key.

3. The electrical connector assembly of claim 1 wherein the body portion of the spring clip member has an opening therein which fits about the plug to secure the clip to the plug.

4. An electrical connector assembly comprising a receptacle having an open end mounted on a trailer of a tractor-trailer rig, a cable connected to a source of electricity on the tractor and having a plug inserted in the receptacle and making electrical contact therewith, an exposed protuberant member on the plug, a cover hinged to the receptacle and biased towards said open end, a latch depending from the cover and disposed against the exposed end of said protuberant member, and a one-piece spring clip member having a body portion secured to the plug and cable assembly and having a U-shaped resilient portion integral with the body biasing the cover against the plug.

5. An electrical connector assembly comprising a receptacle having an open end, a plug and cable assembly, said plug being inserted in the receptacle and making electrical contact therewith, an exposed protuberant member on the plug, a cover hinged to the receptacle and biased towards said open end, a latch depending from the cover and disposed against the exposed end of said protuberant member, and a spring clip member having a body secured to the assembly and an integral resilient U-shaped portion biasing the cover against the plug, said U-shaped portion being integral with a lip member for lifting the spring clip member from the cover.

6. A clip for securing a plug and electrical cable assembly in a receptacle having a hinged cover and adapted to form an electrical connection with the plug, said clip comprising a flat body portion, an opening in the body portion adapted to be disposed about the plug and cable assembly to attach the clip thereto, and a resilient U-shaped portion integral with the body portion and adapted to be disposed against the said cover and press it against the plug when the plug is inserted in the receptacle.

7. A clip for securing a plug of a plug and cable assembly in a receptacle for the plug for forming an electrical connection between a source of electricity and the cable, said receptacle having a hinged closure member biased into a closed position over its open end, said clip being a single sheet of metal having an opening therein for fitting about the plug and cable assembly to secure the clip thereto and being bent into a U-shape at a point from the opening where the closed end of the U will resiliently press against the closure member when the latter rests on the plug while the plug is inserted in the receptacle to bind the plug in the receptacle and retard movement of the plug in the receptacle.

* * * * *